United States Patent [19]

Jarvis

[11] 4,146,769

[45] Mar. 27, 1979

[54] MICROWAVE OVEN DOOR

[75] Inventor: George A. Jarvis, Minneapolis, Minn.

[73] Assignee: Litton Systems, Inc., Beverly Hills, Calif.

[21] Appl. No.: 827,226

[22] Filed: Aug. 24, 1977

[51] Int. Cl.[2] ..... H05B 9/06

[52] U.S. Cl. ..... 219/10.55 D; 126/200

[58] Field of Search ..... 219/10.55 D, 10.55 F, 219/10.55 R; 126/200

[56] References Cited

U.S. PATENT DOCUMENTS

| | | | |
|---|---|---|---|
| 3,430,023 | 2/1969 | Tingley | 219/10.55 D |
| 3,843,859 | 10/1974 | Klemp et al. | 219/10.55 D |
| 3,985,993 | 10/1976 | Imberg et al. | 219/10.55 D |

FOREIGN PATENT DOCUMENTS

| | | | |
|---|---|---|---|
| 1180232 | 2/1970 | United Kingdom | 219/10.55 D |

*Primary Examiner*—Arthur T. Grimley
*Attorney, Agent, or Firm*—Robert E. Lowe

[57] ABSTRACT

A microwave oven door includes a rigid door panel having a frame and hinge effectively bonded to the panel, the frame being supported by the panel. The frame and hinge may be effectively bonded to the panel through attachment to an intermediate structural member which is in turn bonded to the panel. The panel may comprise a glass-metal screen laminate.

4 Claims, 3 Drawing Figures

FIG. 1
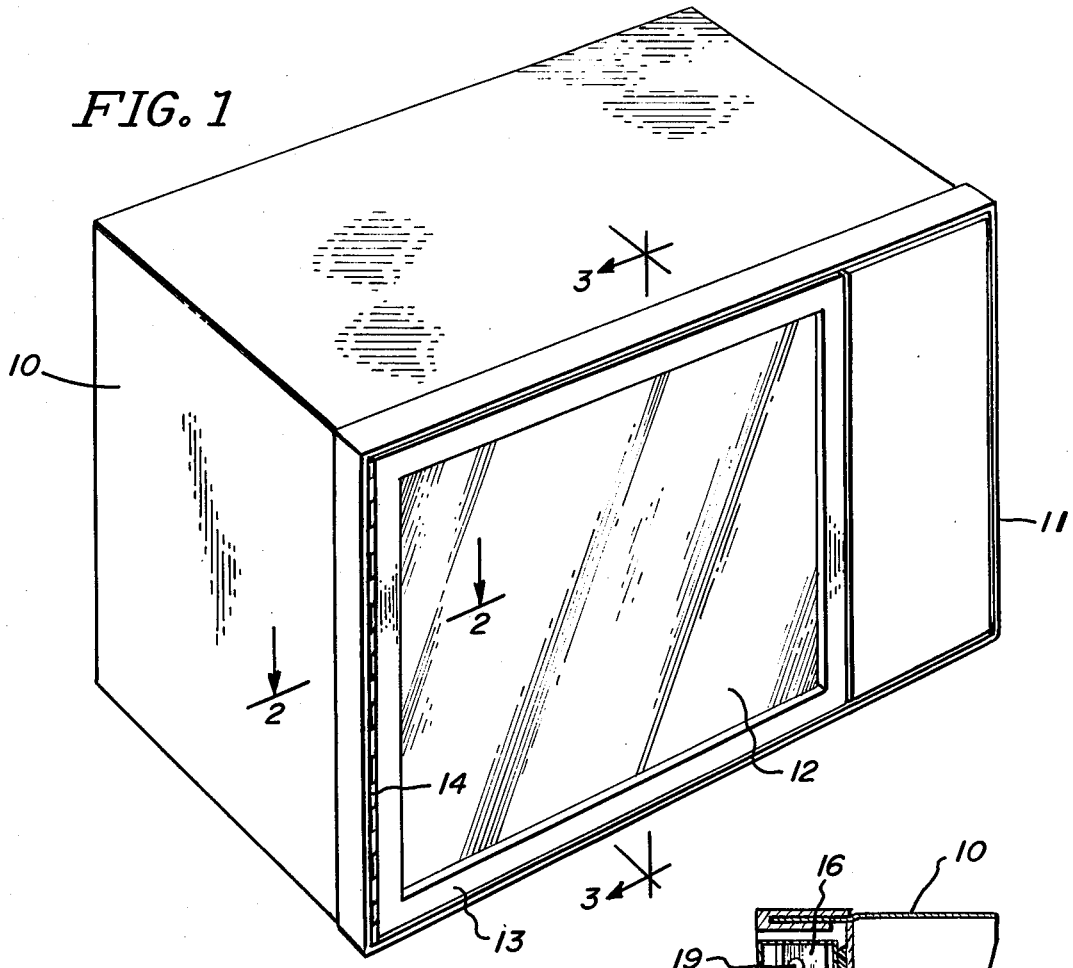
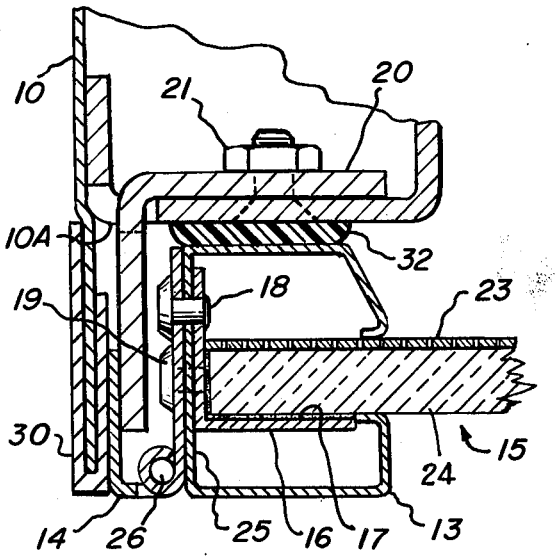
FIG. 2
FIG. 3
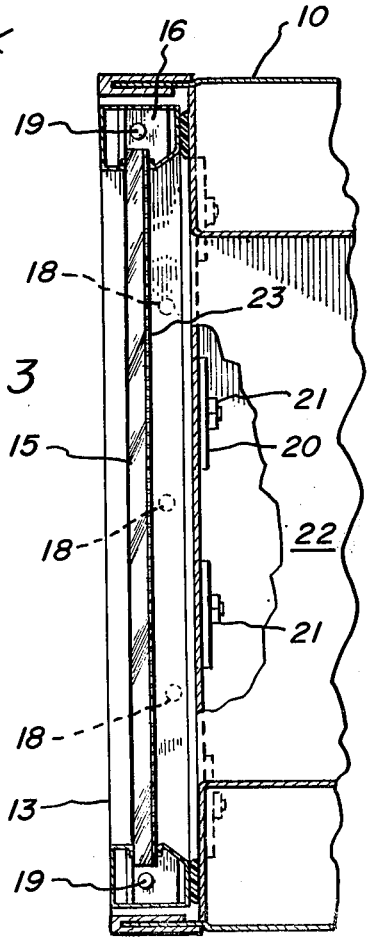

MICROWAVE OVEN DOOR

BACKGROUND OF THE INVENTION

This invention relates to microwave ovens in general and more specifically to the doors for such ovens. It particularly concerns itself with mounting arrangements for microwave oven doors.

Because of the nature of microwave radiation and the requirement to confine such energy to a cooking space, several kinds of microwave oven doors have been suggested in the art. Several of these have been cumbersome, heavy and unattractive. More recently lighter and more stylish doors have been developed using techniques as shown, for example, in U.S. Pat. No. 3,843,859 issued to Eldon J. Klemp and Vernon E. Cassibo and assigned to the assignee of the present invention. That patent teaches a technique for making a glass-screen laminate which is mounted in a frame to form a door.

It has been found that doors of the aforesaid frame mounted laminate variety exhibit certain undesirable characteristics. For example, the glass-metal screen laminate is heavy relative to the mounting frame. Because the weight is cantilevered from the hinge side, the frame may in time sag, raising the possibility of a less effective microwave seal, or may eventually break from the stress of repeated use.

It has been recognized in the present invention that the glass-screen laminate is itself best suited to bear the stress placed on a cantilevered door, more so than the frame. It is therefore an object of the invention to provide a door construction and mounting means that utilizes the glass laminate, rather than the frame around the door, as the primary structural member.

Other objects and advantages of the invention will become obvious as the specification proceeds.

SUMMARY OF THE INVENTION

The present invention provides a rigid door panel member having a frame and hinge effectively bonded to the panel and supported thereby. The frame and hinge may be effectively bonded to the panel directly, or they may be fixed to an intermediate structural member that is in turn bonded to the panel. The door panel may comprise a glass-screen laminate.

BRIEF DESCRIPTION OF THE DRAWINGS

FIG. 1 is a perspective view of a microwave oven including a door embracing the present invention;

FIG. 2 is a partial cross-section view of the door hinge area taken along line 2—2 in FIG. 1; and, FIG. 3 is a partial cross-section view of the oven and door taken along line 3—3 in FIG. 1.

DESCRIPTION OF PREFERRED EMBODIMENTS

FIG. 1 depicts a microwave oven comprised of a cabinet 10, a control panel 11 and a door shown generally at 12. The precise structure of the cabinet 10 and control panel 11 can be widely varied and those shown are primarily for illustrative purposes.

The oven door 12 includes a generally flat door panel 15 substantially coextensive with the front of the cooking cavity portion 22 of the cabinet 10. The door panel 15 may comprise a single rigid metal sheet, or preferably may be comprised of a sheet of glass 24 having a perforated metal screen 23 bonded thereto. The resulting glass-screen lamination may be constructed as described in the aforementioned U.S. Pat. No. 3,843,859, and may include an additional layer of glass or plastic on the obverse side of the screen 23.

The present invention makes use of the fact that the glass-screen laminate panel 15 has substantial rigidity and strength at least as to forces acting along the plane of the glass. A key element in the invention lies in the use of that strength in supporting the door frame 13, rather than using the frame 13 to support the panel 15 as shown in the prior art.

To accomplish the mounting of the door, bracket 16 is bonded directly to the panel by adhesive 17. Any suitable means for securely attaching the bracket 16 to the door panel 15 can be employed and will in part be dependent upon the materials used for each part. For example, if the door panel 15 is metal, the bracket 16 could be an integral part of the structure. The bracket can also be a separate piece and attached by welding, riveting and the like. Where the door panel 15 is glass or a glass laminate, the techniques are more limited and direct bonding with adhesive is preferred. The remaining components of the door are assembled to the bracket 16.

The wrap around door frame 13 is positioned about the periphery of the door panel 15, a vertical surface 25 thereof lying along the bracket 16. One leaf of hinge 14 is placed into contact with the surface 25 of the frame and the three elements, namely bracket 16, door frame 13, and hinge 14 are securely fastened together by means of rivets 18 and 19 or other suitable fastening means.

The second leaf of hinge 14 is securely fastened to a mounting bracket 20, preferably by welding. The bracket 20 is L-shaped and the hinge 14 is attached to one leg of the L, the other leg being provided with apertures to receive fasteners 21 for attachment of the entire assembly to the cabinet 10.

After the door assembly has been attached to the oven cabinet through fasteners 21, the door portion can be opened and closed by rotating it about the hinge pin 26. The structure from the cabinet 10 to the hinge pin 26 is rigid through bracket 20 and one leaf of hinge 14 which is securely attached to the bracket 20. A rigid assembly is also provided on the door side of the hinge through the union of one leaf of the hinge 14, frame 13 and bracket 16, which is in turn adhesively bonded to door panel 15. In this manner the hinge 14 and the frame 13 are effectively bonded to the door panel 15 so that the panel is supported by the hinge and the frame is supported by the panel.

In the described construction and tendency for the frame to warp or sag under the weight of the glass-metal laminate found in the prior art has been overcome. This provides a more durable, trouble-free construction able to withstand the rigorous testing and use required of microwave oven doors.

It is apparent that the adhesive 17 plays an important part in the disclosed construction. Several adhesives are known that are capable of establishing a satisfactory bond between metal and glass. A material that has been found to be quite satisfactory is an anerobic adhesive marketed under the trade name Loc-tite 319 by Loc-tite Corporation, Newington, Conn. Its application is preceded by application of Loc-tite Primer N, a material of the same company.

If desired, the door hinge construction can be hidden from view and the styling of the oven enhanced by extending the cabinet wrap 10 beyond the point of the oven cavity 22, as shown at 10A in FIG. 2. A decorative trim strip 30 can then be fitted to the front of the cabinet to give a pleasing finished appearance.

The oven construction illustrated also includes a gasket 32, typically a carbon loaded vinyl positioned around the periphery of the door to absorb higher order harmonic frequencies that might escape from the oven cavity.

I claim:

1. In a microwave oven having a cooking cavity and an oven door mounted to the oven and moveable between an open and closed position wherein the oven door extends substantially across the cooking cavity in the closed position, the improvement comprising:

door panel means comprising at least one glass sheet and one perforated metal sheet; bracket means adhesively bonded to said glass sheet; frame means substantially encircling said glass sheet, said frame means being rigidly fastened to said bracket means and at least partially supported by said glass sheet; and hinge means fastened to said bracket means, said hinge means in turn being fastened to said oven whereby siad door rotates about said hinge means to the open and closed positions.

2. The apparatus of claim 1 wherein said glass sheet and said metal sheet are adhesively bonded together to form a glass-metal screen laminate assembly.

3. In a microwave oven including an oven door rotatable about a door hinge to open and close the oven wherein one side of the hinge is fixed to the oven and the other side is fixed to the oven door, and wherein the door includes a planar glass sheet, the improvement comprising:

bracket means adhesively bonded to one edge of said glass sheet, said door hinge being attached to said bracket.

4. The apparatus of claim 3 further comprising a frame substantially encircling said glass sheet and at least partially supported thereby.

* * * * *